US009095205B2

(12) United States Patent
Stofko

(10) Patent No.: US 9,095,205 B2
(45) Date of Patent: Aug. 4, 2015

(54) ORTHODONTIC TOOTHBRUSH

(76) Inventor: Joseph A. Stofko, Gibsonia, PA (US)

( * ) Notice: Subject to any disclaimer, the term of this patent is extended or adjusted under 35 U.S.C. 154(b) by 361 days.

(21) Appl. No.: 13/165,169

(22) Filed: Jun. 21, 2011

(65) Prior Publication Data

US 2012/0324668 A1 Dec. 27, 2012

(51) Int. Cl.

| | |
|---|---|
| ***A46B 9/04*** | (2006.01) |
| ***A46B 9/02*** | (2006.01) |
| ***A46B 5/00*** | (2006.01) |

(52) U.S. Cl.

CPC ..... *A46B 9/025* (2013.01); *A46B 5/0054* (2013.01); *A46B 5/0075* (2013.01); *A46B 9/026* (2013.01); *A46B 9/045* (2013.01); *A46B 2200/1066* (2013.01)

(58) Field of Classification Search

CPC ..... A46B 9/02; A46B 9/025; A46B 9/028; A46B 9/04
USPC ..... 15/167.1, DIG. 5; D4/104
IPC ..... A46B 9/04
See application file for complete search history.

(56) References Cited

U.S. PATENT DOCUMENTS

| | | | | |
|---|---|---|---|---|
| 890,143 | A * | 6/1908 | Kuzzer | 15/167.1 |
| 1,901,646 | A | 4/1931 | Hicks | |
| 1,950,767 | A | 3/1934 | Abbott | |
| 2,168,964 | A * | 8/1939 | Strasser | 15/167.1 |
| 2,978,724 | A * | 4/1961 | Gracian | 15/167.1 |
| 3,100,309 | A | 8/1963 | Gambino | |
| 3,229,318 | A * | 1/1966 | Clemens | 15/167.1 |
| 3,678,528 | A | 7/1972 | Haije | |
| 3,722,020 | A * | 3/1973 | Hills | 15/167.1 |
| 4,010,509 | A | 3/1977 | Huish | |
| D248,696 | S | 8/1978 | Greenberg | |
| 4,382,309 | A * | 5/1983 | Collis | 15/167.2 |
| 4,493,125 | A * | 1/1985 | Collis | 15/167.2 |
| 4,706,322 | A * | 11/1987 | Nicolas | 15/106 |

(Continued)

FOREIGN PATENT DOCUMENTS

EP 0221000 A1 5/1987

OTHER PUBLICATIONS

Form PCT/ISA/220, PCT Notification of Transmittal of the International Search Report and the Written Opinion of the International Search Authority, or the Declaration, PCT/US2012/043496, Date Mailed Nov. 29, 2012.

(Continued)

*Primary Examiner* — Joseph J Hail
*Assistant Examiner* — Marc Carlson
(74) *Attorney, Agent, or Firm* — Paul D. Bangor, Jr.; Clark Hill PLC

(57) ABSTRACT

An orthodontic toothbrush comprising a handle, an attached head, and a plurality of bristles. The bristles define at least one well having the shorter length bristles at the center or bottom of the well and relatively longer length bristles bordering the wells. The wells are preferably spaced at the average distance between orthodontic braces. A plurality of bristles off the longitudinal plane of the toothbrush head are angled or slanted toward the toothbrush head median longitudinal plane, while another plurality of bristles are perpendicular to the toothbrush head plane. The well accommodates an orthodontic bracket or brace wherein the shortest bristles in the well clean the archwire and face of the orthodontic bracket and the relatively longer bristles clean under the wings of the bracket, the sides and rear of brackets and the teeth.

11 Claims, 4 Drawing Sheets

(56) References Cited

U.S. PATENT DOCUMENTS

| | | | | | |
|---|---|---|---|---|---|
| 4,972,542 | A | | 11/1990 | Moshos et al. | |
| D315,450 | S | | 3/1991 | Wagner | |
| 5,040,260 | A | * | 8/1991 | Michaels | 15/167.1 |
| 5,046,213 | A | * | 9/1991 | Curtis et al. | 15/167.1 |
| 5,072,481 | A | | 12/1991 | Weyer | |
| 5,119,522 | A | | 6/1992 | Potts | |
| D329,946 | S | * | 10/1992 | Curtis et al. | D4/104 |
| 5,201,092 | A | * | 4/1993 | Colson | 15/167.1 |
| 5,230,118 | A | | 7/1993 | Chamma | |
| 5,325,560 | A | * | 7/1994 | Pavone et al. | 15/106 |
| 5,327,607 | A | * | 7/1994 | Wagner | 15/167.2 |
| 5,335,389 | A | * | 8/1994 | Curtis et al. | 15/167.1 |
| 5,341,537 | A | * | 8/1994 | Curtis et al. | 15/167.1 |
| 5,537,708 | A | | 7/1996 | Luposello | |
| 5,628,082 | A | | 5/1997 | Moskovich | |
| 5,881,425 | A | * | 3/1999 | Hudson et al. | 15/167.1 |
| 6,016,587 | A | * | 1/2000 | Savitt et al. | 15/167.1 |
| 6,260,227 | B1 | * | 7/2001 | Fulop et al. | 15/167.1 |
| 6,272,714 | B2 | * | 8/2001 | Beals | 15/167.1 |
| 6,408,477 | B1 | | 6/2002 | Culbreth | |
| 6,493,897 | B2 | | 12/2002 | Culbreth | |
| 6,564,416 | B1 | * | 5/2003 | Claire et al. | 15/167.1 |
| 6,918,154 | B2 | | 7/2005 | Ben-Ari | |
| 7,269,872 | B2 | * | 9/2007 | Fattori et al. | 15/22.1 |
| D563,106 | S | * | 3/2008 | Chan et al. | D4/101 |
| 7,698,772 | B1 | | 4/2010 | Hauser, Jr. | |
| 7,707,677 | B2 | * | 5/2010 | Moskovich et al. | 15/167.1 |
| 8,239,996 | B2 | * | 8/2012 | Garbers et al. | 15/167.1 |
| 8,434,190 | B2 | * | 5/2013 | Stief et al. | 15/191.1 |
| 2002/0108199 | A1 | | 8/2002 | Culbreth | |
| 2003/0131433 | A1 | * | 7/2003 | Pavone | 15/143.1 |
| 2004/0068811 | A1 | * | 4/2004 | Fulop et al. | 15/22.2 |
| 2005/0108842 | A1 | * | 5/2005 | Shunock | 15/167.1 |
| 2005/0188487 | A1 | | 9/2005 | Moskovich et al. | |
| 2008/0109979 | A1 | | 5/2008 | Jo | |
| 2010/0306941 | A1 | * | 12/2010 | Erskine-Smith et al. | 15/167.1 |

OTHER PUBLICATIONS

Form PCT/ISA/210, PCT International Search Report for International Application No. PCT/US2012/043496, Date Mailed Nov. 29, 2012.

Form PCT/ISA/237, PCT Written Opinion of the International Searching Authority for International Application No. PCT/US2012/043496, Date Mailed Nov. 29, 2012.

* cited by examiner

ORTHODONTIC TOOTHBRUSH

CROSS REFERENCE TO RELATED APPLICATIONS

N/A.

FIELD OF THE INVENTION

The present invention relates in general to toothbrushes, and has more particular reference to toothbrushes of the sort commonly provided for brushing teeth with brackets and braces used in orthodontia.

BACKGROUND OF THE INVENTION

Orthodontic toothbrushes of the sort herein are adapted to clean teeth and prevent decalcification and gingivitis which can result in areas around orthodontic appliances. Prior art orthodontic toothbrushes typically involve head designs with channels of shorter bristles to accommodate the brackets and brace elements while adjacent taller bristles clean the gumline (gingival surface) or top (occlusal surface) of the teeth.

One typical orthodontic toothbrush is described in U.S. Pat. No. 6,260,227 to Fulop, et al., disclosing a toothbrush head wherein the bristle pattern forms a V-shaped channel far less than the depth of a typical bracket or band. The shortest group of bristles is positioned along the center row of the longitudinal centerline axis. Adjacent to the shortest bristles is an intermediate row, bilaterally, to clean the occlusal (top) and gingival (bottom) portions of the tooth's crown and bracket and band. Adjacent to the intermediate height bristles are rows of tufts of taller bristles. A fourth set of the tallest bristles is located at the distal end of the toothbrush head. The limit of this design is that the bristle heights create a V-shaped channel longitudinally whereas the anatomy of a typical brace is square in this dimension. The bristles of the V-shaped design diverge away from the area of the brace which is most difficult to clean and where the highest degree of decalcification occurs: the area of the brace which is immediately adjacent to the tooth.

U.S. Pat. No. 5,325,560 to Pavone, et al., discloses a similar orthodontic toothbrush where the bristles also form a channel for the brace elements. The Pavone toothbrush has outermost rows of bristles of relatively soft and long length. The bristles in the pattern gradually shorten in length, with the shortest and stiffest bristles positioned along the longitudinal centerline axis. In addition, U.S. Pat. No. 4,706,322 to Nicolas, teaches another orthodontic toothbrush with a channel for brace elements. The Nicolas toothbrush has shorter bristles in the middle and two longitudinal rows of tufts of taller bristles inclined towards the outside of the brushing head and diverging from the median longitudinal plane, while two other rows of tufts are angled towards the median longitudinal plane.

When brushes with channels of the sort described, having shorter, near-uniform length of bristles, are used on teeth with brackets, the shorter bristles forming the depth of the channel tend to cause the brush to glide atop the outermost surface of the brackets. This gliding action prevents the bristles adjacent to the channel from reaching or effectively cleaning the surfaces of the underlying tooth which are farthest from the toothbrush head.

SUMMARY OF THE INVENTION

It would be desirable to have a toothbrush that would not glide along the outermost aspect of the brackets, thus giving an improved cleaning between the teeth, a traditional trouble spot and common cause of gross plaque accumulation. Accordingly, an orthodontic toothbrush without a channel, leading to improved cleaning for the average orthodontic patient would be advantageous. One such solution is to have depressed receptacles or "wells" configured an average inter-brace distance apart and designed to fit over one or more braces at a time. Wells would, by their nature, allow the braces to seat deeper into the bristle area than with brushes having channels. It would also be desirable to have clusters of taller bristles that angled inward toward the median longitudinal plane to allow more efficient cleaning under the tie-wings of the braces, which is another brushing trouble spot for orthodontic patients. In addition, a brush that is wider in the occluso-gingival dimension, in combination with the more precise fit of the braces into the wells, could guide the brush's median longitudinal plane to naturally guide the brush head over the row of brackets, guiding the brush to reach more gingivally with less conscientious compliance required by the brusher, reducing the occurrence of decalcification and gingivitis in orthodontic patients. The wells would function as a guide to keep the longitudinal axis of the head over the line of braces, where the wider occluso-gingival dimension will clean the gumline more thoroughly and efficiently.

In a first aspect, the present invention comprises an orthodontic toothbrush for cleaning teeth and any orthodontic appliances positioned thereon, comprising: a handle and a head member disposed on or integrally formed with the handle; said toothbrush head having a planar surface and a median plane; a first plurality of bristles extending perpendicular from the planar surface, said first plurality of bristles having a plurality of lengths; a second plurality of bristles extending from the planar surface and inclined towards the median plane; and said first and second plurality of bristles disposed to define at least one well.

In accordance with another aspect of the orthodontic toothbrush, the bristles are in a plurality of tufts.

In a further aspect, the at least one well is comprised of relatively shorter bristles bounded circumferentially by relatively longer bristles.

In yet a further aspect of the orthodontic toothbrush, the at least one well comprises one well.

In an additional aspect of the orthodontic toothbrush, the at least one well comprises a plurality of wells.

In three different aspects of the orthodontic toothbrush, the plurality of wells comprises two wells, three wells, or four wells.

In yet a further aspect of the orthodontic toothbrush, a distance between the center of adjacent wells is an inter-bracket distance of 8-12 millimeters. In another aspect of the orthodontic toothbrush, the inter-bracket distance is 8 millimeters. In a further aspect of the orthodontic toothbrush, the inter-bracket distance is 11 millimeters. In yet a further aspect of the orthodontic toothbrush, the inter-bracket distance is 12 millimeters.

In a further aspect of the orthodontic toothbrush, the first plurality of bristles comprise a third plurality of bristles not greater than 6 millimeters long, a fourth plurality of bristles 6 to 8 millimeters long, and a fifth plurality of bristles not less than 8 millimeters long. In yet a further aspect of the orthodontic toothbrush, the third plurality of bristles are less than 6 millimeters long, the fourth plurality of bristles are 6 to 8 millimeters long, and the fifth plurality of bristles are greater than 8 millimeters long. In an additional aspect of the orthodontic toothbrush, the third plurality of bristles average 5 millimeters long, the fourth plurality of bristles average 7 millimeters long, and the fifth plurality of bristles average 9 millimeters long.

In a further aspect of the orthodontic toothbrush, the second plurality of bristles are in tufts attached in rows parallel to the median plane.

In an additional aspect of the orthodontic toothbrush, the first plurality of bristles farthest from the median plane are composed of tufts of bristles of relatively longer length.

In another aspect of the orthodontic toothbrush, the first plurality of bristles includes a sixth plurality of bristles of an intermediate length along a first transverse plane at a proximal end of the head nearest the handle, and a seventh plurality of bristles of the intermediate length along a second transverse plane at the distal end of the head.

In yet another aspect of the orthodontic toothbrush, the first plurality of bristles includes a row of bristles in tufts along a transverse plane about midway between the proximal and distal ends In an additional aspect, the length of the brush head member may be approximately 125%-225% its width. The relatively wider than usual orthodontic toothbrush head allows for placement of more bristles in more strategic locations and more inward angled bristles, leading to improved cleaning along the gumline and the surrounding areas of the braces respectively. The handle of the orthodontic toothbrush has either a gripping texture or attached gripping materials, while the handle is preferably made by injection molding. The brush head member is preferably angled from the handle to improve the comfort of the act of brushing.

These and other advantages of the invention will be appreciated by reference to the detailed description of the preferred embodiment(s) that follow.

BRIEF DESCRIPTION OF THE DRAWINGS

For the present disclosure to be easily understood and readily practiced, the present disclosure will now be described for purposes of illustration and not limitation in connection with the following figures, wherein.

DETAILED DESCRIPTION OF PREFERRED EMBODIMENT(S) OF THE INVENTION

In the following detailed description, reference is made to the accompanying examples and figures that form a part hereof, and in which is shown, by way of illustration, specific embodiments in which the inventive subject matter may be practiced. These embodiments are described in sufficient detail to enable those skilled in the art to practice them, and it is to be understood that other embodiments may be utilized and that structural or logical changes may be made without departing from the scope of the inventive subject matter. Such embodiments of the inventive subject matter may be referred to, individually and/or collectively, herein by the term "invention" merely for convenience and without intending to voluntarily limit the scope of this application to any single invention or inventive concept if more than one is in fact disclosed. The following description is, therefore, not to be taken in a limited sense, and the scope of the inventive subject matter is defined by the appended claims and their equivalents.

Figure 1:
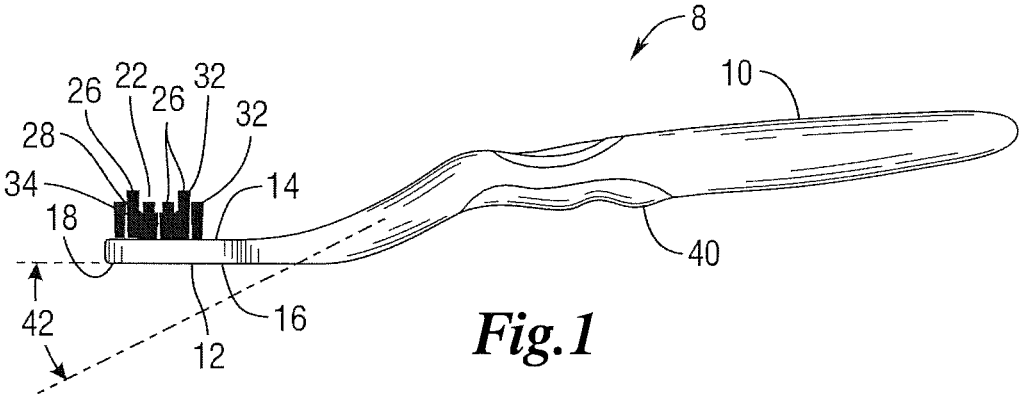
FIG. 1 is a side elevational view of a first aspect of the orthodontic toothbrush having one well.
Figure 2:
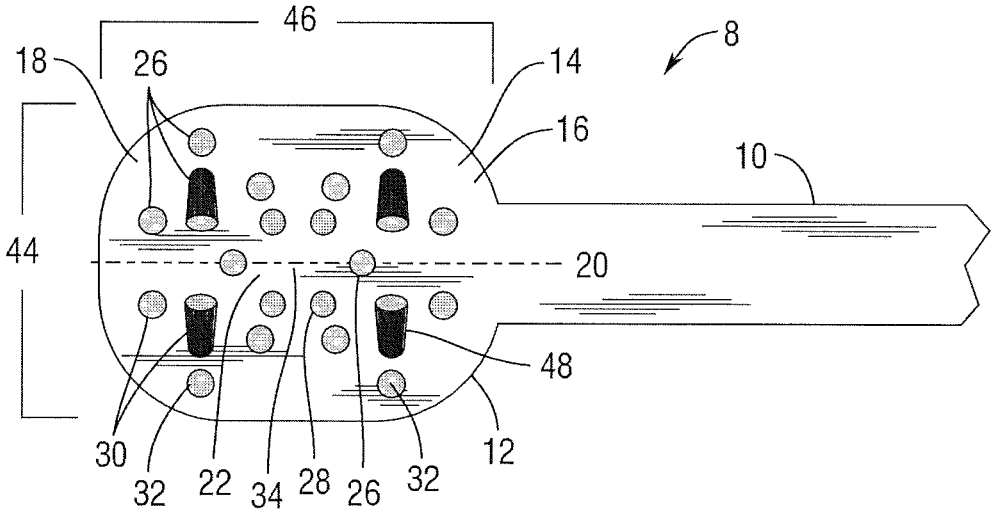
FIG. 2 is a top view of the orthodontic toothbrush of FIG. 1 having one well.
Figure 3:
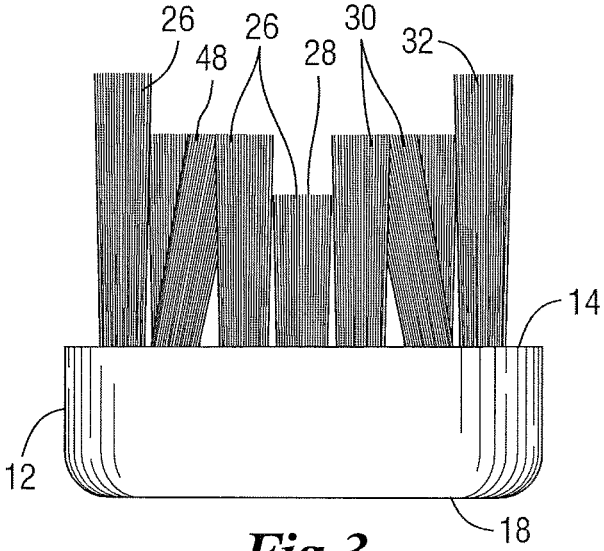
FIG. 3 is a front view of the orthodontic toothbrush of FIG. 1, FIG. 4, FIG. 6, and FIG. 8 utilizing perpendicular bristles of various lengths and bristles inclined towards the median plane and illustrating the planar surface of the toothbrush head.

FIGS. 1-3 illustrate a first orthodontic toothbrush 8 according to the present invention. In FIG. 1, an elongated handle 10 is attached at one end to an end of an elongated head member 12. The head member 12 has a generally planar top surface 14, a proximal end 16, a distal end 18. The head member 12 has bristles 26 of various lengths embedded therein. In preferred embodiments, the toothbrush 8 incorporates gripping material 40. In some preferred embodiments, the toothbrush head member 12 may be disposed on the toothbrush handle 10 at an angle 42.

FIG. 2 illustrates the toothbrush head member 12 has a median longitudinal plane at centerline 20 dividing the top surface 14. The toothbrush head member 12 has a width 44 and a length 46 and a single well 22 formed by bristles 26. Well 22, as exemplified in FIG. 2, the bristles 26 comprises shorter bristles 28 nearest a well center 34, then farther from the well center 34 are medium length bristles 30 and farther from the well center 34 are taller bristles 32. A plurality of bristles 48 leans towards the median longitudinal plane 20. Preferably, a plurality of medium-length bristles 30 are disposed at the proximal end 16 and at the distal end 18 of the head member 12.

FIG. 3 illustrates the head member 12 having a planar top surface 14 having embedded perpendicular bristles 26 and bristles 48 at an angle inclined towards the median plane 20. In preferred embodiments, bristles 26 are arranged in tufts.

Figure 4:
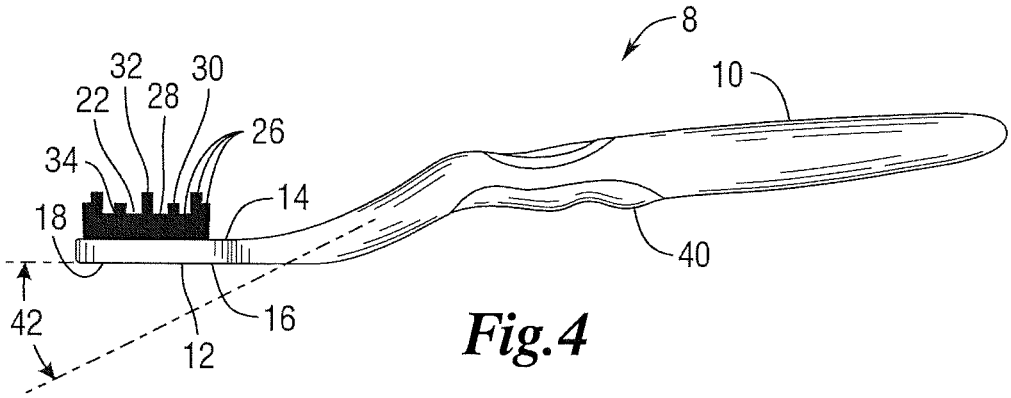
FIG. 4 is a side elevational view of a second aspect of the orthodontic toothbrush having two wells, illustrating a toothbrush head at an angle relative to the toothbrush handle.
Figure 5:
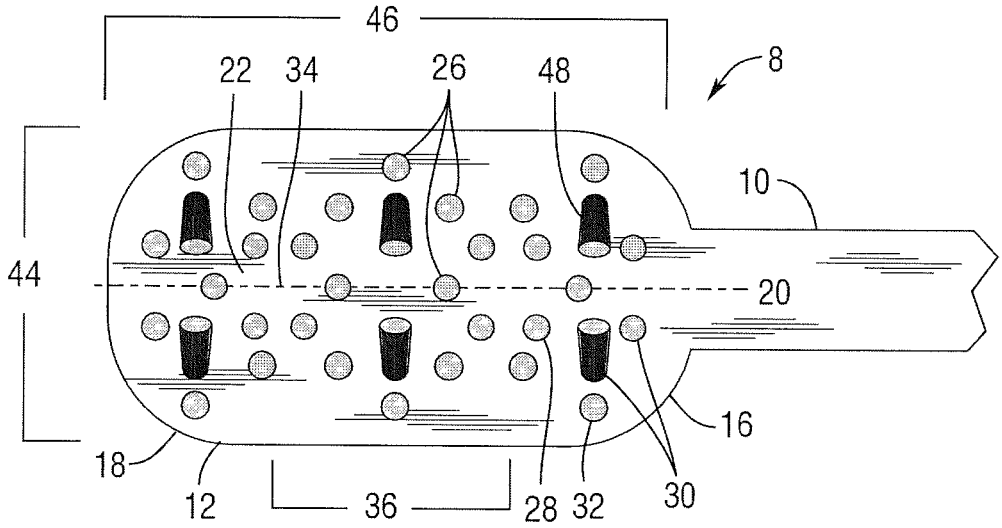
FIG. 5 is a top view of the orthodontic toothbrush of FIG. 4 having two wells defined by perpendicular bristles of various lengths and bristles inclined towards the median plane.

Another preferred embodiment of the orthodontic toothbrush 8, as shown in FIGS. 3-5, comprises two wells 22 formed by bristles 26 of varying lengths. As shown in FIG. 4, the head member 12 has a generally planar top surface 14, a proximal end 16, a distal end 18. An elongated handle 10 is attached to proximal end 16 of elongated head member 12. The head member 12 has bristles 26 of various lengths embedded therein. In preferred embodiments, the toothbrush 8 incorporates gripping material 40. In some preferred embodiments, the toothbrush head member 12 may be disposed on the toothbrush handle 10 at an angle 42.

FIG. 5 illustrates the toothbrush head member 12 has a median longitudinal plane at a centerline 20 dividing the top surface 14. Each of the two wells 22, as shown in FIG. 5, comprises shorter bristles 28 nearest the well centers 34, then farther from the well centers 34 are medium length bristles 30 and farther yet from the well centers 34 are disposed taller bristles 32. A plurality of bristles 48 leans towards the median longitudinal plane 20. In preferred embodiments, the distance between the two well centers 34 is the average distance 36 between orthodontic brackets or braces (not shown). In some preferred embodiments, a plurality of medium-length bristles 30 are disposed at the proximal end 16 and at the distal end 18 of the head member 12. FIG. 3 illustrates the head member 12 of this preferred embodiment has a planar top surface 14 having embedded perpendicular bristles 26 and bristles 26 at an angle inclined towards the median plane 20. In preferred embodiments, bristles 48 are arranged in tufts.

Figure 6:
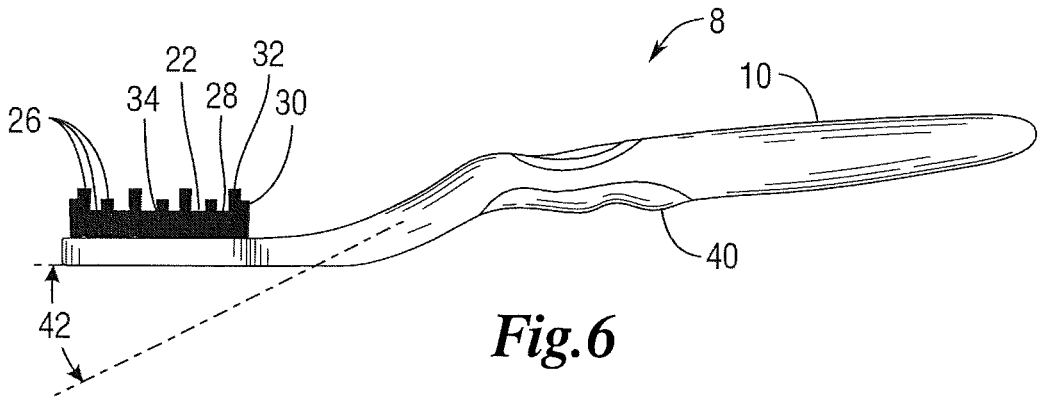
FIG. 6 is a side elevational view of a third aspect of the orthodontic toothbrush having three wells defined by perpendicular bristles of various lengths and bristles inclined towards the median plane.
Figure 7:
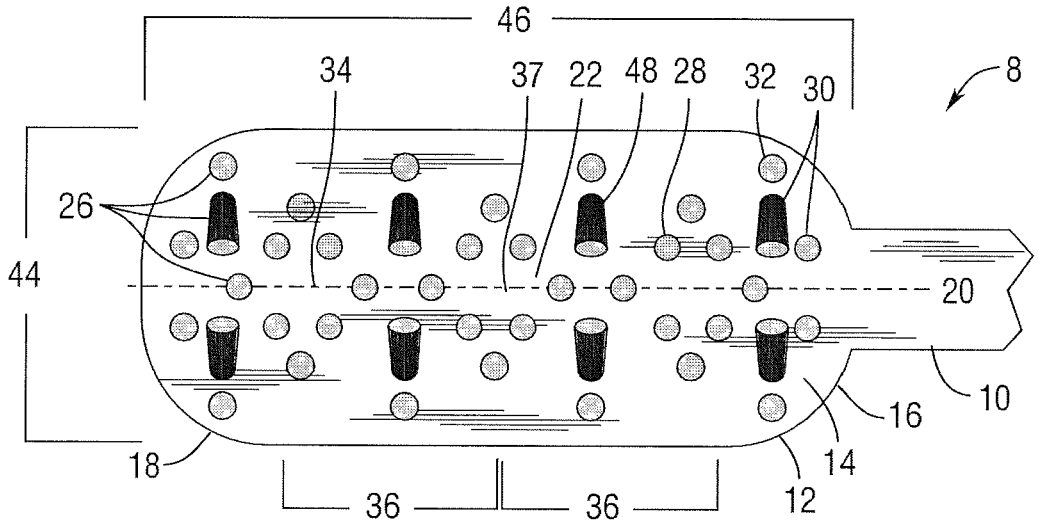
FIG. 7 is a top view of the orthodontic toothbrush of FIG. 6 having three wells defined by perpendicular bristles of various lengths and bristles inclined towards the median plane.

Another preferred embodiment of the orthodontic toothbrush 8 has three wells 22 formed by bristles 26 of varying lengths in as shown in FIGS. 3, 6 and 7. As shown in FIG. 6, an elongated handle 10 is attached to proximal end 16 of elongated head member 12. The head member 12 has a generally planar top surface 14, a proximal end 16, and a distal end 18. The head member 12 has bristles 26 of various lengths embedded therein. Preferably, handle 10 incorporates gripping material 40. In some preferred embodiments, the toothbrush head member 12 may be disposed on the toothbrush handle 10 at an angle 42.

FIG. 7 illustrates the toothbrush head member 12 has a median longitudinal plane at a centerline 20 dividing the top surface 14. Each of the three wells 22, as shown in FIG. 7, comprises shorter bristles 28 nearest the well centers 34, then farther from the well centers 34 are disposed medium length bristles 30 and farther yet from well centers are disposed taller bristles 32. A plurality of bristles 48 lean towards the median longitudinal plane 20. In preferred embodiments, the distance between the two well centers 34 is the average distance 36 between orthodontic brackets or braces (not shown). In some preferred embodiments, a plurality of medium-length bristles 30 are disposed at the proximal end 16 and at the distal end 18 of the head member 12. FIG. 3 illustrates the head member 12 of this preferred embodiment has a planar top surface 14 having embedded perpendicular bristles 26 and bristles 48 at an angle inclined towards the median plane 20. In preferred embodiments, bristles 26 are arranged in tufts.

Figure 8:
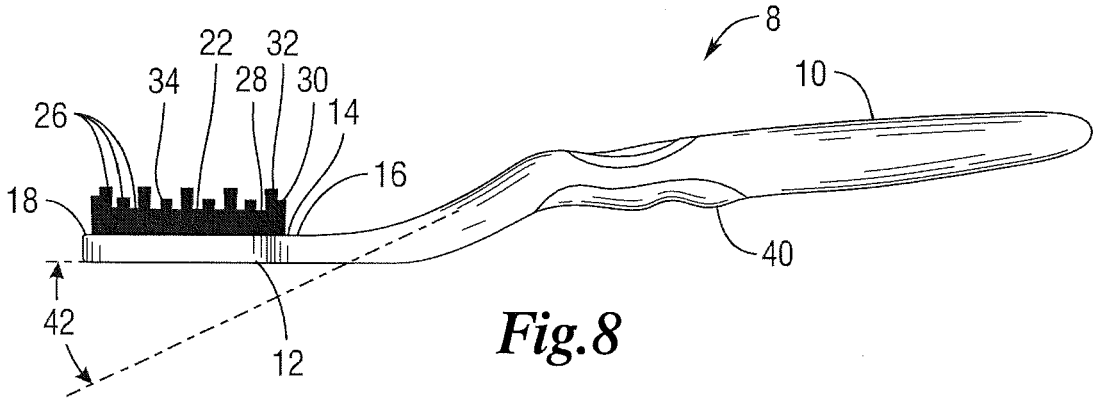
FIG. 8 is a side elevational view of a fourth aspect of the orthodontic toothbrush having four wells defined by perpendicular bristles of various lengths and bristles inclined towards the median plane.
Figure 9:
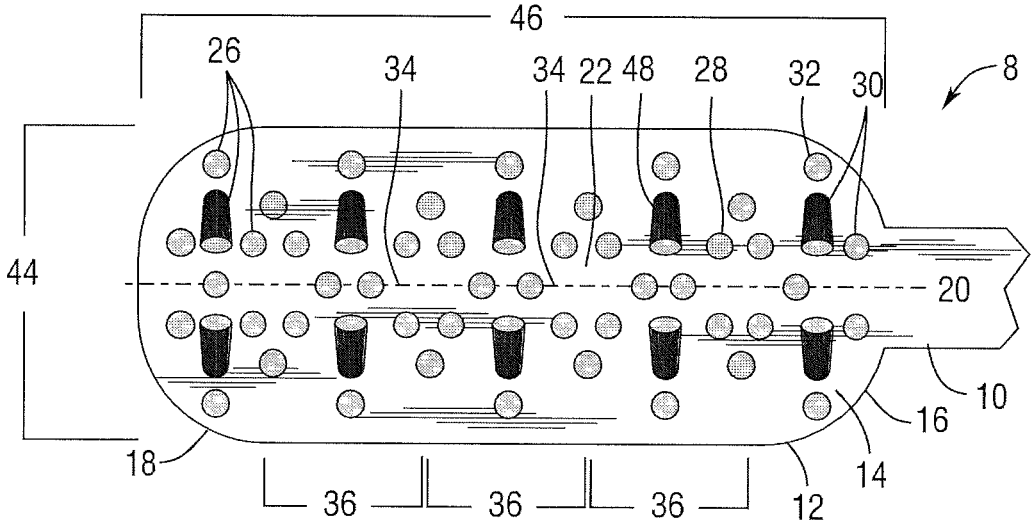
FIG. 9 is a top view of the orthodontic toothbrush of FIG. 8 defined by perpendicular bristles of various lengths and bristles inclined towards the median plane.

Still another aspect of the orthodontic toothbrush 8 has four wells 22 formed by bristles 26 of varying lengths in as shown in FIGS. 3, 8 and 9. As shown in FIG. 8, an elongated handle 10 is attached to proximal end 16 of elongated head member 12. The head member 12 has a generally planar top surface 14, a proximal end 16, a distal end 18. The head member 12 has bristles 26 of various lengths embedded therein. In preferred embodiments, the handle 10 incorporates gripping material 40. In some preferred embodiments, the toothbrush head member 12 may be disposed on the toothbrush handle 10 at an angle 42.

FIG. 9 illustrates the toothbrush head member 12 has a median longitudinal plane at a centerline 20 dividing the top surface 14. Each of the four wells 22, as shown in FIG. 9, comprises shorter bristles 28 nearest the well centers 34, then farther from the well centers 34 are medium length bristles 30 and farther yet from the wall centers 34 are disposed taller bristles 32. A plurality of bristles 48 lean towards the median longitudinal plane 20. In preferred embodiments, the distance between the two well centers 34 is the average distance 36 between orthodontic brackets or braces (not shown). In some preferred embodiments, a plurality of medium-length bristles 30 are disposed at the proximal end 16 and at the distal end 18 of the head member 12. FIG. 3 illustrates the head member 12 having a planar top surface 14 having embedded perpendicular bristles 26 and bristles 26 at an angle inclined towards the median plane 20. In preferred embodiments, bristles 26 are arranged in tufts.

Bristles of varying lengths, stock, stiffness, material composition, and thickness are all within the scope of the present invention. The bristles 26 are, optionally, may preferably be disposed in a pattern of individual bristles, a plurality bristles bunched together as tufts, or a bristle bar arrangement. Tufts may be preferably round or elongated or oval-shaped.

Preferably, the plurality of taller length bristles 32 are in one or more longitudinal rows and adjacent to the wells 22. More preferably, at least one longitudinal row of taller length bristles 32 are perpendicular to the top planar surface 14, while at least one longitudinal row of bristles 26 is slanting or inclined towards the median longitudinal plane 20. Preferably, the longitudinal row of bristles 26 slanting towards the median plane 20 are medium length bristles 30. In other preferred embodiments, the longitudinal row of bristles 26 slanting towards the median plane 20 are taller length bristles 32. In other preferred embodiments, a plurality of taller length bristles 32 is perpendicular to the top planar surface 14 and positioned on the transverse plane 38 between adjacent wells 22.

In some preferred embodiments, the lengths of bristles 26 of shorter-length bristles 28 average not more than 6 millimeters long, the average length of medium-length bristles 30 is 6 to 8 millimeters long, and taller length bristles 32 average at least 8 millimeters long. In more preferred embodiments shorter-length bristles 28 average less than 6 millimeters long, the average length of medium-length bristles 30 is 6 to 8 millimeters long, and the taller bristles 32 average greater than 8 millimeters long. In still more preferred embodiments, the average length of shorter-length bristles 28 is about 5 millimeters, the average length of medium-length bristles 30 is about 7 millimeters, and the average length of taller bristles 32 is about 9 millimeters.

The head member 12 is preferably a rounded rectangular shape or more preferably an elongated oval. Preferably, the length 46 of the head member 12 is about 125%-225% of the width 44 of the head member 12. The width 44 of the head member 12 may be any practical width. Preferably the width 44 is about 16 millimeters. In some embodiments, the orthodontic toothbrush 8 has one well 22 and the head member 12 is about 20 millimeters long. In another preferred embodiment, the orthodontic toothbrush has two wells 22 and the head member length 46 is about 30 millimeters. In still another preferred embodiment, the orthodontic toothbrush has three wells 22 and the head member length 46 is about 36 millimeters. In yet another preferred embodiment, the orthodontic toothbrush has four wells 22 and the head member length 46 is about 38 millimeters.

As illustrated in FIG. 4, the handle 10 of the orthodontic toothbrush 8 is preferably selected from a group consisting of handles having gripping material 40 attached thereto, and handles 10 having gripping texture. The head member 12 may preferably be angled or offset relative to the handle 10, more preferably the angle 42 between head member 12 and handle 10 ranges between zero to thirty-five degrees.

Orthodontic toothbrushes 8 according to the instant invention may be manufactured by any one of several technologies currently available. The handle 10 and head member 12 may be injection molded, in a single or multistep process. While certain of the bristles 26 may be attached by staples, the bristle bars, tufts and other densely packed bristles may be attached using staple-free technology such as fusion, thermoforming, or injection molding.

When used, the well 22 of the orthodontic toothbrush 8 accommodates an orthodontic bracket or brace wherein the shortest bristles 28 in the well 22 clean the archwire and face of the orthodontic bracket and the relatively longer or slanting bristles clean the sides and rear of brackets and the teeth. The angled clusters of taller bristles 32 will contact the occlusal and gingival surfaces of the teeth and clean under the tie-wings of the braces. The head member 12, in combination with the wells 22, guides the brush 8 to reach more gingivally to reduce the widespread problem of gingivitis in less-compliant orthodontic patients. Further, the brush 8 can be turned 90 degrees in the palm of the hand so that the parallel clusters of taller bristles 32 can be threaded interdentally under the orthodontic archwire to clean in between the teeth. This is advantageous as a separate instrument is usually required to complete this task.

In the foregoing Detailed Description, various features are grouped together in a single embodiment to streamline the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

The invention claimed is:

1. An orthodontic toothbrush for cleaning teeth and an orthodontic appliance positioned thereon, comprising:

a longitudinal handle and a proximal end of a head disposed on or integrally formed with the handle;

the head having a single planar surface for bristle attachment, a distal end and a longitudinal midline;

a plurality of first tufts of bristles extending perpendicularly from the planar surface, the plurality of first tufts of bristles having a first length;

a plurality of second tufts of bristles extending perpendicularly from the planar surface, the plurality of second tufts of bristles having a second length longer than the first length;

a plurality of third tufts of bristles extending from the planar surface, the plurality of third tufts of bristles having a third length longer than the second length;

wherein a plurality of the first, second and third tufts of bristles are arranged to create a plurality of wells;

wherein each well is a recess sized to surround a bracket or brace of said orthodontic appliance to receive the bracket or brace and comprises a cluster of at least one first tuft of bristles with a collective top surface area sized to substantially match an area of an outermost face of the bracket or brace and longitudinally flanked on both sides by a plurality of second tufts of bristles, and wherein the wells are longitudinally spaced apart an average inter-bracket distance along the midline or a line parallel thereto;

wherein the wells are separated longitudinally by at least one pair of symmetrically opposing inclined third tufts of bristles, each pair comprising one third tuft disposed on each side of a plane perpendicular to the planar surface and coincident with said midline or line parallel thereto, wherein each said opposing third tuft is inclined toward its respective other inclined third tuft without touching or crossing its respective other third tuft or said plane;

wherein the distal end of the head contains a lateral row of a plurality of second tufts and a plurality of third tufts where the second tufts are located inside of the third tufts with respect to said plane with the plurality of third tufts located laterally outward from the second tufts;

wherein the proximal end of the head contains a lateral row of a plurality of second tufts and a plurality of third tufts where the second tufts are located inside of the third tufts with respect to said plane with the plurality of third tufts located laterally outward from the second tufts; and wherein each cluster of first tufts of bristles contacts and cleans the outermost face of the bracket or brace and the second and third tufts of bristles contact and clean the teeth and sides of the bracket or brace.

2. The orthodontic toothbrush of claim 1 wherein the plurality of wells acts to guide the head of orthodontic toothbrush over brackets or braces of the orthodontic appliance.

3. The orthodontic toothbrush of claim 1 wherein the plurality of wells comprises two wells and wherein a distance between respective centers of the two wells is substantially equal to an average distance between brackets or braces of the orthodontic appliance.

4. The orthodontic toothbrush of claim 1 wherein the plurality of wells comprises three wells and wherein a distance between respective centers of adjacent wells of the three wells is substantially equal to an average distance between brackets or braces of the orthodontic appliance.

5. The orthodontic toothbrush of claim 1 wherein the plurality of wells comprises four wells and wherein a distance between respective centers of adjacent wells of the four wells is substantially equal to an average distance between brackets or braces of the orthodontic appliance.

6. The orthodontic toothbrush of claim 1 wherein a distance between respective centers of adjacent wells is from about 8 millimeters to about 12 millimeters.

7. The orthodontic toothbrush of claim 1 wherein a distance between respective centers of adjacent wells is about 8 millimeters.

8. The orthodontic toothbrush of claim 1 wherein a distance between respective centers of adjacent wells is about 11 millimeters.

9. The orthodontic toothbrush of claim 1 wherein a distance between respective centers of adjacent wells is about 12 millimeters.

10. The orthodontic toothbrush of claim 1 wherein the first length is less than or equal to about 6 millimeters, the second length is greater than 6 millimeters and less than or equal to about 8 millimeters and the third length is greater than about 8 millimeters.

11. The orthodontic toothbrush of claim 1 wherein the first length is about 5 millimeters, the second length is about 7 millimeters and the third length is about 9 millimeters.

* * * * *